US005316141A

United States Patent [19]

Jalomo

[11] Patent Number: 5,316,141

[45] Date of Patent: May 31, 1994

[54] REMOTE CONTROL COVER

[76] Inventor: Bernabe F. Jalomo, 2105 Santa Cleotilde, Laredo, Tex. 78041

[21] Appl. No.: 958,785

[22] Filed: Oct. 9, 1992

[51] Int. Cl.[5] ..... B65D 85/38

[52] U.S. Cl. ..... 206/320; 206/305; 150/128; 229/198.2

[58] Field of Search ..... 150/119, 128, 143; 190/119, 126, 902; 206/37-39, 305, 315.11, 316.1-316.3, 320, 328, 425, 523; 224/195, 226, 228, 236, 240, 241; 229/68, 141, 125.37, 198.2

[56] References Cited

U.S. PATENT DOCUMENTS

| | | | |
|---|---|---|---|
| 3,135,455 | 6/1964 | Santangelo | 229/198.2 |
| 3,250,454 | 5/1966 | Steiger | 229/198.2 |
| 3,344,973 | 10/1967 | Studen | 206/523 |
| 3,550,837 | 12/1970 | Erb | 229/125.37 |
| 3,813,017 | 5/1974 | Pimsleur | 224/240 |
| 4,119,249 | 10/1978 | Hanson | 224/236 |
| 4,241,829 | 12/1980 | Hardy | 206/328 |
| 4,263,951 | 4/1981 | Siegel | 206/38 |
| 4,424,841 | 1/1984 | Smith | 224/240 |
| 4,479,596 | 10/1984 | Swanson . | |
| 4,739,897 | 4/1988 | Butler . | |
| 4,836,256 | 6/1989 | Meliconi | 206/305 |
| 4,901,852 | 2/1990 | King . | |
| 4,925,149 | 5/1990 | DiFrancesca et al. . | |
| 4,928,819 | 5/1990 | Jakobsen | 206/316.2 |
| 5,048,734 | 9/1991 | Long et al. | 224/236 |
| 5,092,459 | 3/1992 | Uljanic et al. | 206/320 |
| 5,172,838 | 12/1992 | Rowell et al. | 206/316.2 |

*Primary Examiner*—Jimmy G. Foster
*Attorney, Agent, or Firm*—Richard C. Litman

[57] ABSTRACT

A cover for rectangular electronic devices has four walls, a bottom, and a flap which is folded over an open end. The flap attaches to the front of the cover by hook and loop material. Preferably, the cover is made from polyvinyl chloride, and is strong, light, resilient, heat weldable, and resists deterioration. The cover is optionally provided with a foam rubber liner. Fabrication is accomplished by welding the sides of a cruciform material pattern, only four seams being required.

2 Claims, 3 Drawing Sheets

REMOTE CONTROL COVER

BACKGROUND OF THE INVENTION

1. Field of the Invention

The present invention relates to a cover for a remote control device.

2. Description of the Prior Art

Covers for substantially rectangular electronic devices are well known. U.S. Pat. No. 4,479,596, issued to Albert W. Swanson on Oct. 30, 1984, discloses a paging device holder having a bottom, five vertical walls, and a folding cover flap secured by hook and loop fastener.

U.S. Pat. No. 4,739,897, issued to Lorraine M. Butler on Apr. 26, 1988, discloses a remote controller cover having a five sided body open at the top, and including a lining of foam rubber or the like.

An entirely encompassing and sealed pager cover made from a stretchable plastic is seen in U.S. Pat. No. 4,901,852, issued to Jeffrey S. King on Feb. 20, 1990.

U.S. Pat. No. 4,925,149, issued to Peter DiFrancesca et al. on May 15, 1990, exemplifies a cushioning holder for a remote controller, the holder featuring flexible and stretchable material, such as foam rubber.

None of the above inventions and patents, taken either singly or in combination, is seen to describe the instant invention as claimed.

SUMMARY OF THE INVENTION

As the use of remote control devices for controlling televisions, video cassette recorders, and the like has become widespread, there has arisen a need to protect these control devices from damage arising from common household hazards. Dust, cigarette ash, spilled drinks and food, and other materials may enter an unprotected control device, and render it inoperative.

The cover is made from a cruciform pattern which is heat welded to form a pouch having four walls and a bottom. One side extends beyond the others, and is folded down to provide a top panel. The cover is preferably made from plastic, such as polyvinyl chloride, so that the finished cover is reasonably strong, light, flexible, and inexpensively manufactured. Suitable thermosetting plastics may also be used. Mating hook and loop patches are provided for closure fastening. Optionally, a sheet of plastic foam lines the back wall and flap, thereby providing cushioning for the delicate electronic device to be contained therein.

Accordingly, it is a principle object of the invention to provide a cover which excludes and resists deterioration from dust, particles, and fluids.

It is another object of the invention to provide a flexible cover, whereby the cover is not distended or damaged by pressure.

It is a further object of the invention to provide a flexible cover which is made from inexpensive material and which lends itself to manufacture by inexpensive and uncomplicated technique.

Still another object of the invention is to provide a self-fastening closure.

A further object of the invention is to provide a cushioning layer within the cover, whereby a remote control device is protected against minor bumps and collisions.

It is yet an additional object of the invention to provide assembly resulting in failure-resistant body panel joints.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
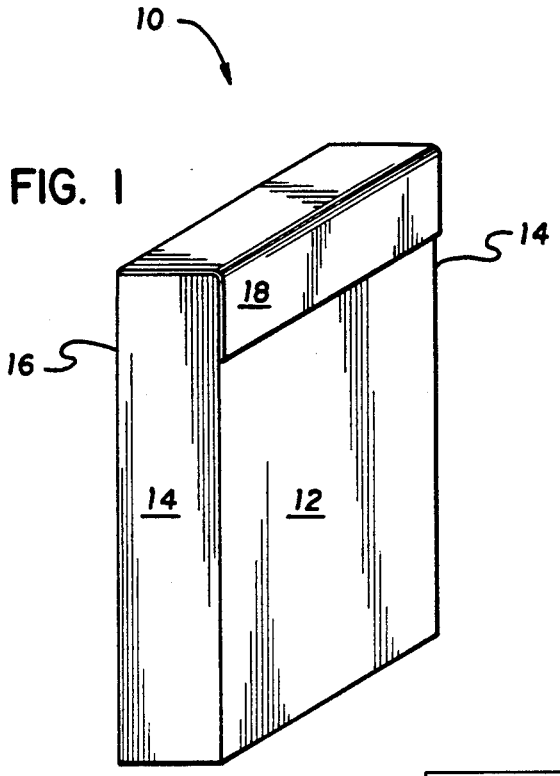
FIG. 1 is a perspective view of the invention in a sealed configuration.
Figure 2:
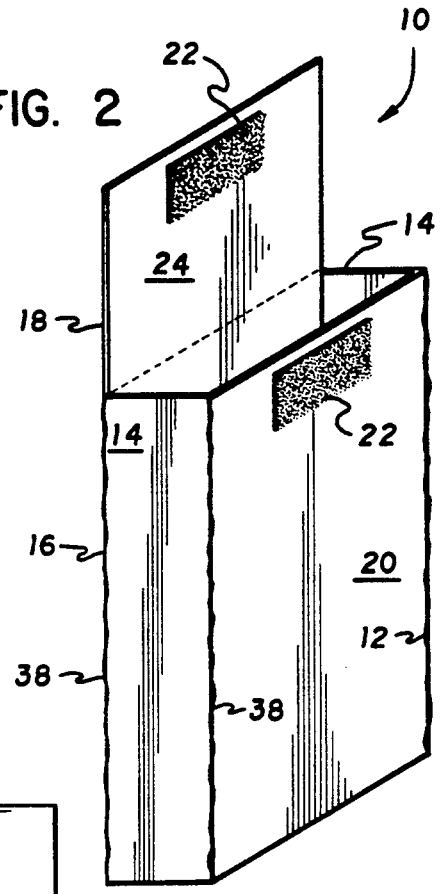
FIG. 2 is a perspective view of the invention with a sealing flap in an open position.

The present invention, seen in FIG. 1, comprises a holder 10 for small electronic devices, such as a television remote controller (not shown). As shown in FIG. 2, the holder 10 includes a front wall 12, two side walls 14,14, and a rear wall 16. The height of rear wall 16 extends beyond the height of the side and front walls 14,14,12, the extension forming a flap cover 18. Flap cover 18 is folded over to meet a front surface 20 of front wall 12, thus sealing the holder 10. Corresponding patches of hook and loop material 22 are affixed to the inside surface 24 of the flap cover 18 and to the front wall front surface 20, so that upon even light contact, the flap cover 18 engages the body front wall 12 and becomes fastened.

Material selected for fabrication preferably includes plastics, such as polyvinyl chloride, which are light, strong, flexible, and capable of being welded by heat. Suitable thermosetting plastics may also be used. Fabrication of the novel cover 10 is performed as follows.

Figure 3:
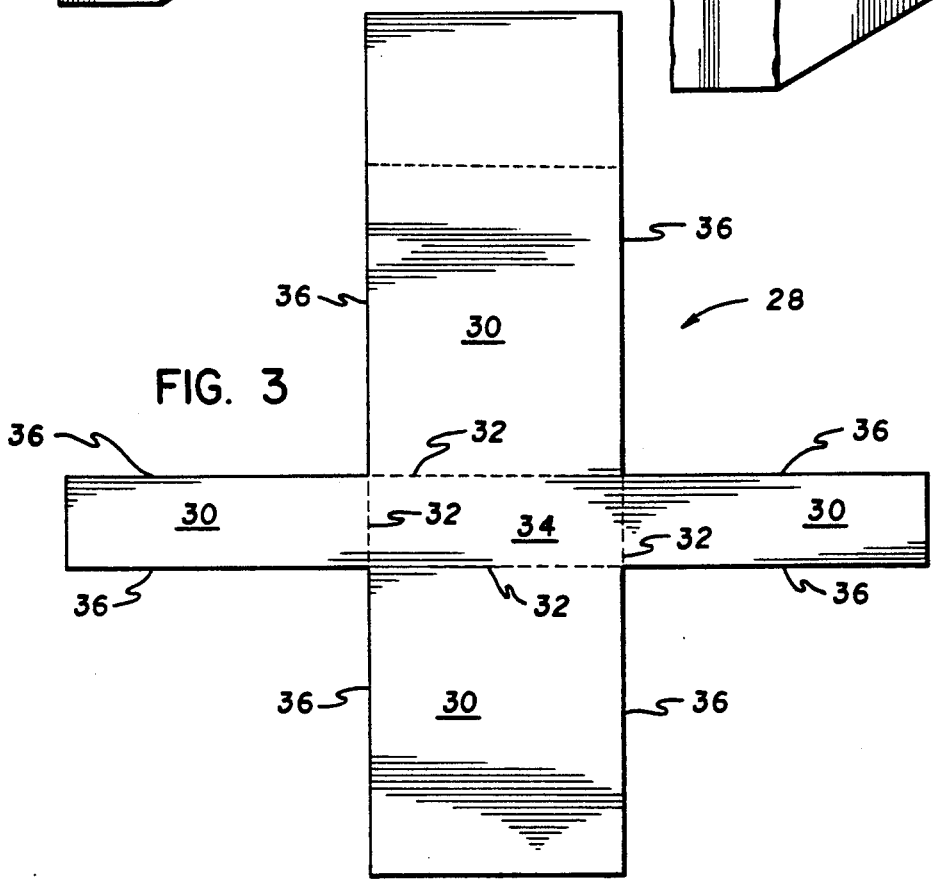
FIG. 3 is a top plan view of a material pattern.
Figure 4:
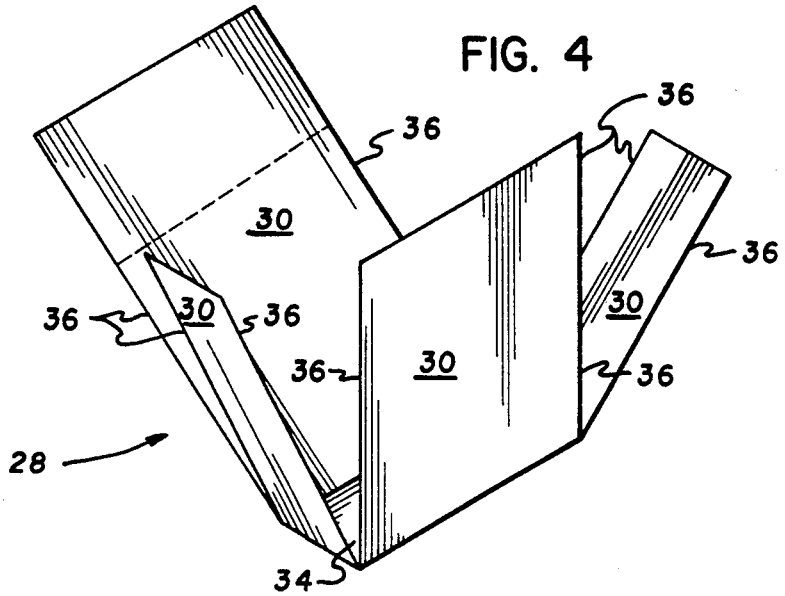
FIG. 4 is a perspective view of the material pattern, with flaps extended upwardly.

A cruciform pattern 28, seen in FIG. 3, is cut from the selected material. As shown in FIG. 4, each side 30 of the cruciform is bent upwardly along fold lines 32 (FIG. 3). Upon being bent to extend upwardly, sides 30,30,30,30, which will hereinafter be referred to as flaps 30,30,30,30, define a bottom panel 34, between the four fold lines 32,32,32,32.

Figure 5A:
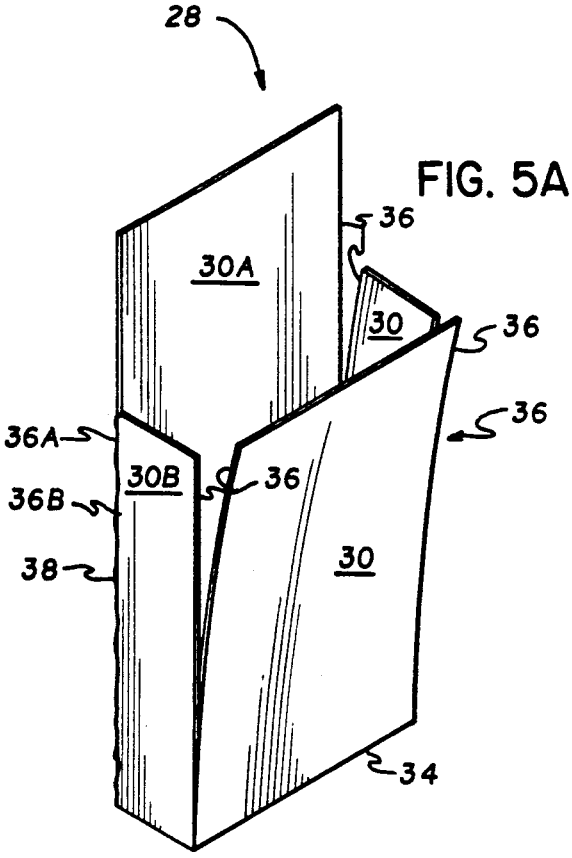
FIGS. 5A, 5B, 5C, and 5D are perspective views of the pattern, showing progressive completion of seam welds.
Figure 5B:
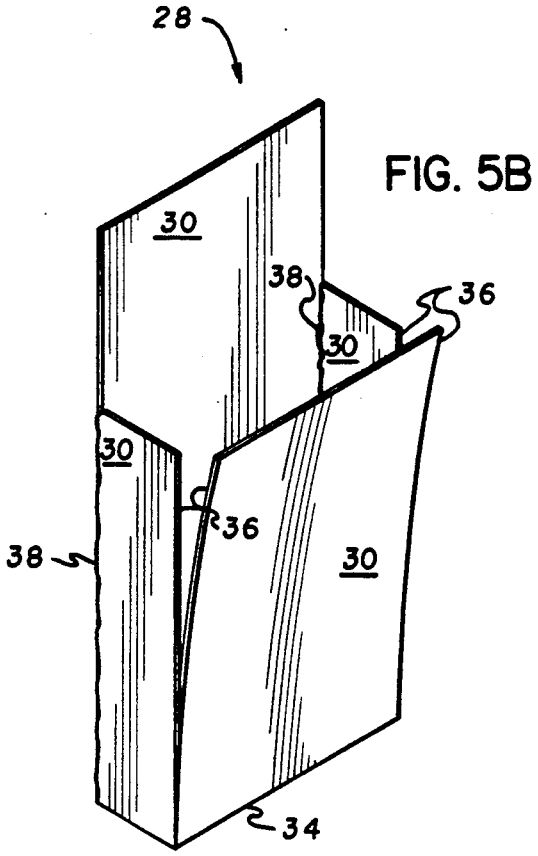
Figure 5C:
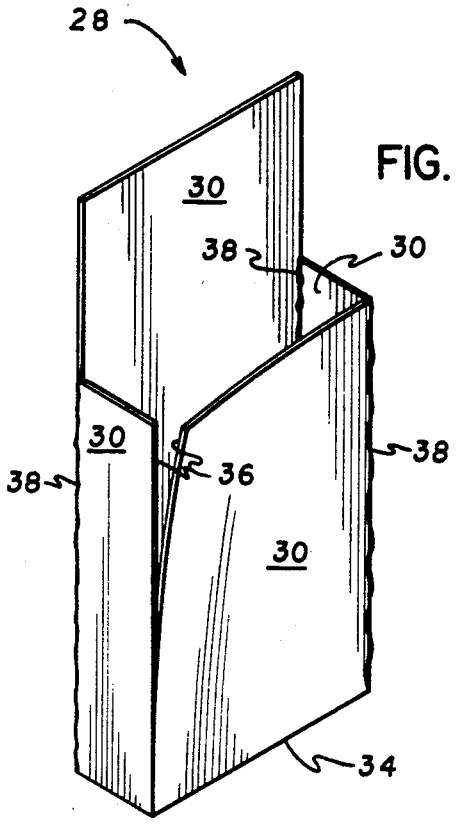
Figure 5D:
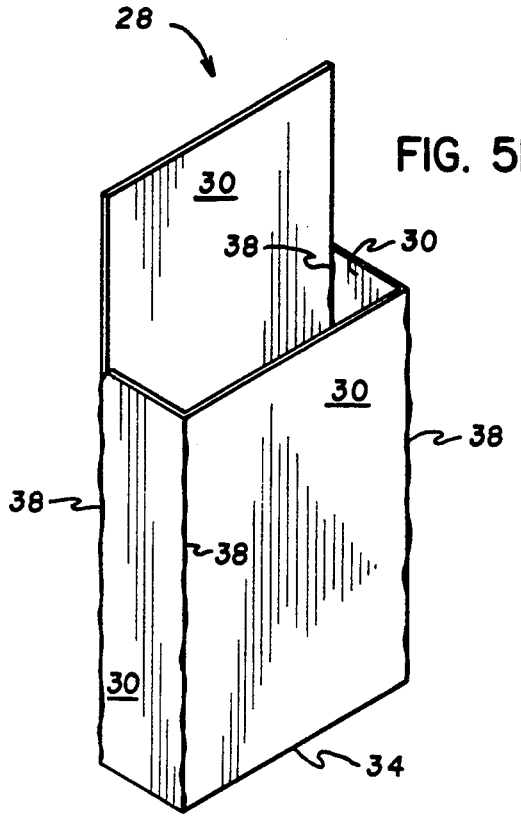

Any two adjacent flaps 30,30 are held so that their respective edges 36,36 abut. In FIG. 5A, the rear flap 30B and one side flap 30A are shown in this position. Heat is then applied until the edges 36A,36B fuse, forming a weld bead or joint 38. This is an advantageous method of joining flap edges 36,36,36,36, since resultant joints 38,38,38,38 are very strong, and do not require additional parts or materials.

The remaining flaps 30,30 . . . 30,30 are progressively similarly joined, each flap 30 to an adjacent flap 30, until four welded joints 38,38,38,38 are formed, and the four flaps 30,30,30,30 are joined along their respective abutting edges 36,36, 36,36, 36,36, and 36,36. This process is illustratively shown in FIGS. 5A through 5D, although it is to be understood that the order in which the joints 38,38,38,38 are made can be any order, and does not necessarily follow the serial order shown in FIGS. 5A through 5D.

The corresponding hook and loop patches 22 can be affixed to the holder 10 before or after joining flaps 30,30,30,30.

Figure 6:
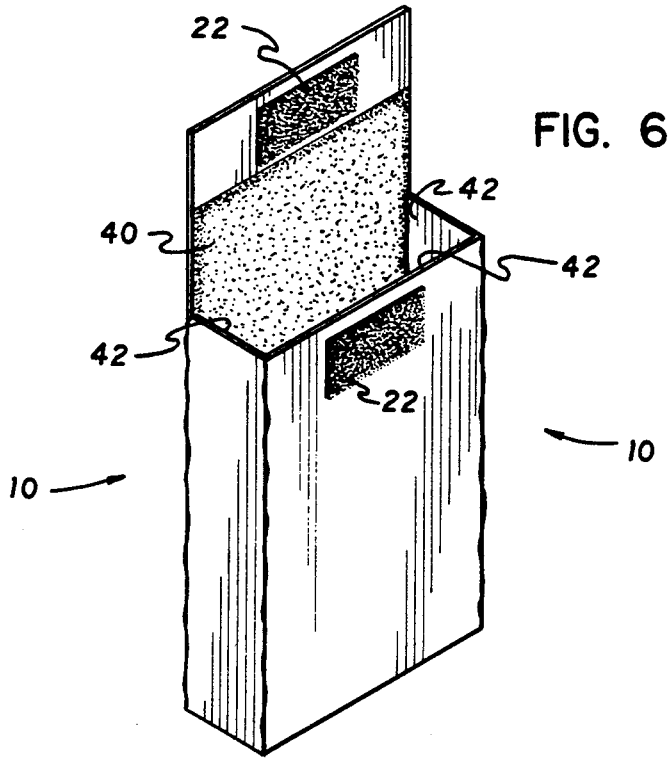
FIG. 6 is a perspective view of an alternative embodiment of the invention with a sealing flap in an open position.

In an alternative embodiment, as shown in FIG. 6, a sheet of resilient material 40, such as foam rubber, can be affixed to front surface 20 of the rear wall 16, and/or to any interior surface 42 of any wall 12,14 or 14.

The resultant cover 10 can be used with many different models of remote controller, minor variations in controller dimension being accommodated by the resilience of the material. Also, patches of hook and loop material 22 permit fastening the flap cover 18 without precise positioning at a predetermined point, as is required by fasteners such as snaps (not shown). Selection of a plastic material such as polyvinyl chloride and employment of heat welding to join flaps 30,30,30,30 further result in hold or core 10 which is sufficiently resilient to yield upon being dropped or bumped, and which tends to hold its rectangular configuration when not being stretched, flattened or otherwise disturbed.

It is to be understood that the present invention is not limited to the embodiments described above, but encompasses any and all embodiments within the scope of the following claims.

I claim:

1. A remote control cover comprising a hollow body having a solid front wall having a front surface, a solid rear wall having a front surface, solid right side and solid left side walls, and a solid bottom panel, said walls and bottom panel being continuously attached at their respective joints, and a flexible flap cover having an inside surface, said flexible flap cover being an extension of said rear wall, whereby said flat cover is folded over to close said hollow body, said hollow body further including hook and loop material fastening means, there being one of said hook and loop material fastening means mounted on said flap cover inside surface and the other of said hook and loop material fastening means being mounted on said front wall surface such that said one and said other hook and loop material fastening means overlap and fasten when said flap cover is folded over, thus closing said remote control cover, whereby a remote control device is protected against minor bumps and collisions, said hollow body being made of flexible, plastic material, whereby said joints formed by joining said plastic material are at least as strong as said hollow body, so that said body flexibly yield to pressure and said hollow body flexibly conforms to a configuration of a remote control device inserted thereinto within elastic limits of said hollow body, said plastic material enabling said flap cover to bend and thus close said hollow body, said hollow body maintaining a rectangular configuration in the absence of pressure and in the absence of a remote control device therein, said control cover further including a plastic foam sheet attached to said rear wall front surface, said plastic foam sheet extends from said rear wall front surface at least partially thereabove and onto said inside surface of said flexible flap cover, and said plastic foam sheet extends to and terminates at a transverse line immediately beneath said one of said hook and loop material fastening means mounted on said flap cover inside surface.

2. A remote control cover comprising a hollow body having a solid front wall having a front surface, a solid rear wall having a front surface, solid right side and solid left side walls, and a hollow panel, said walls and bottom panel being continuously attached by suitable means forming respective joints, and a flexible flap cover having an inside surface, said flexible flap cover being an extension of said rear wall, whereby said flap cover is folded over to close said hollow body, said hollow body further including hook and loop material fastening means, there being one of said hook and loop material fastening means mounted on said flap cover inside surface and the other of said hook and loop material fastening means being mounted on said front wall front surface such that said one and said other hook and loop material fastening means overlap and fasten when said flap cover is folded over, thus closing said remote control cover, whereby a remote control device is protected against minor bumps and collisions, said hollow body being made of a unitary flexible, plastic material having a cruciform pattern, whereby said joints formed by said suitable means are at least as strong as said hollow body, so that said body flexibly yields to pressure and said hollow body flexibly conforms to a configuration of a remote control device inserted thereinto within elastic limits of said hollow body, said plastic material enabling said flap cover to bend and thus close said hollow body, said hollow body maintaining a rectangular configuration in the absence of pressure and in the absence of a remote control device therein, there further being a plastic foam sheet attached to said rear wall front surface, said plastic foam sheet extends from said rear wall front surface at least partially thereabove and onto said inside surface of said flexible flap cover, and said plastic foam sheet extends to and terminates at a transverse line immediately beneath said one of said hook and loop material fastening means mounted on said flap cover inside surface.

* * * * *